United States Patent [19]

Brotherton et al.

[11] 4,440,086

[45] Apr. 3, 1984

[54] IMPACT ARMING DEVICE FOR A FUZE

[75] Inventors: Carl R. Brotherton, Tempe; Peter M. Rendek, Chandler, both of Ariz.

[73] Assignee: Motorola Inc., Schaumburg, Ill.

[21] Appl. No.: 499,007

[22] Filed: May 27, 1983

[51] Int. Cl.[3] ..... F42C 15/34

[52] U.S. Cl. ..... 102/254; 102/222

[58] Field of Search ..... 102/254, 251, 252, 253, 102/256, 272, 275, 234, 239, 222, 221

[56] References Cited

U.S. PATENT DOCUMENTS

| | | | |
|---|---|---|---|
| 734,697 | 7/1903 | Gathmann | 102/239 |
| 766,022 | 7/1904 | Dawson et al. | 102/252 |
| 1,302,902 | 5/1919 | Davies | 102/252 |
| 1,311,678 | 7/1919 | Cartwright | 102/252 |
| 1,455,741 | 5/1922 | Wennerstrom | 102/254 |
| 1,687,341 | 10/1928 | Lukens et al. | 102/222 |
| 2,436,378 | 2/1948 | Chenow et al. | 102/252 |
| 3,264,995 | 8/1966 | Libby et al. | 102/273 X |
| 3,351,018 | 11/1967 | Bedall | 102/275 |
| 4,145,971 | 3/1979 | Graham et al. | 102/232 |

*Primary Examiner*—David H. Brown

*Attorney, Agent, or Firm*—Eugene A. Parson

[57] ABSTRACT

A slideably mounted interrupter, or barrier, is constructed to interrupt or break a detonating train when held in a first position by a leaf spring in an unflexed mode, and to complete the detonating train when the interrupter is moved, by a predetermined amplitude of impact force, to a second position wherein the leaf spring is flexed and firmly wedged into a channel to prevent the interrupter from bouncing or otherwise moving out of the second position.

14 Claims, 4 Drawing Figures

IMPACT ARMING DEVICE FOR A FUZE

BACKGROUND OF THE INVENTION

This invention generally pertains to an impact arming device for a fuze. Generally, in explosive missiles and the like it is desirable to have some form of interrupter or barrier to prevent the fuze from exploding prior to impact. Upon impact the interrupter or barrier is moved to provide a complete path for a detonation train so that the missile may be actuated. In the prior art, the interrupter or barrier is moved upon impact by an explosive element, which generally consisted of a mild detonating fuze chord.

In U.S. Pat. No. 4,145,971, entitled "Electronic Time Delay Safety and Arming Mechanism", issued Mar. 27, 1979, a sliding member operates as an interrupter or barrier to break the detonating train until such time as the fuze is to be activated. To activate the fuze an explosive device drives the sliding member into an activated position wherein the detonating train is completed and firing may occur. In this particular patent the fuze is designed for spinning explosive projectiles and the sliding mechanism is held in the actuated position by centrifugal force.

The sliding member described in the above referenced patent will not operate in impact arming devices such as the present invention. Impact arming devices generally have a different set of problems which impose different restrictions on the device. For example, the impact arming device must arm when a specific impact occurs but, generally, should not arm upon the occurrence of smaller impacts. Further, the device should be rugged and relatively simple to manufacture.

SUMMARY OF THE INVENTION

The present invention pertains to an impact arming device for a fuze containing a detonating train, which device includes an interrupter slideably mounted for movement between a first position wherein the detonating train is interrupted and a second position wherein the detonating train is completed, said interrupter being held in the first position by a leaf spring which prevents movement out of the first position until the application of at least a predetermined amplitude of impact force on the fuze whereupon the interrupter slides into the second position and the leaf spring flexes into a binding position which prevents bouncing of the interrupter element out of the second position. In some instances the leaf spring element, or other portions of the interrupter, might be utilized to complete an electrical circuit.

It is an object of the present invention to provide a new and improved impact arming device for use in a fuze containing a detonating train.

It is a further object of the present invention to provide a new and improved impact arming device which is extremely rugged and simple to manufacture.

It is a further object of the present invention to provide a new and improved impact arming device which is easily adjustable to be actuated with different amplitudes of impact force.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the figures.

DESCRIPTION OF THE PREFERRED EMBODIMENTS

Figure 1:
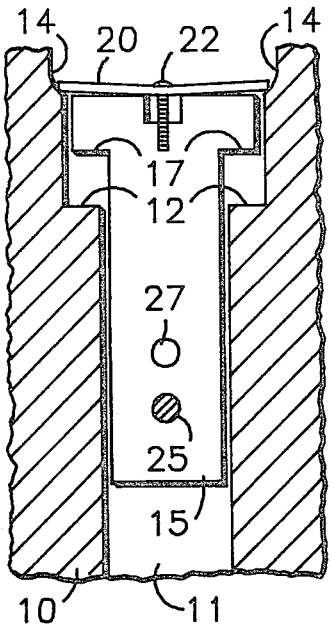
FIG. 1 is a cross sectional view of an impact arming device embodying the present invention, said device being in the unarmed position.
Figure 2:
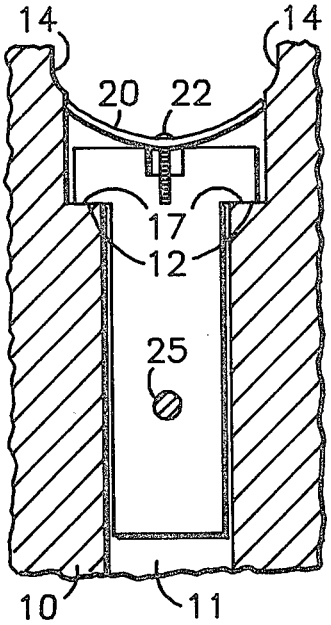
FIG. 2 is a view similar to FIG. 1 with the impact arming device moved into the armed position.

Referring specifically to FIGS. 1 and 2, a body or housing, designated 10, is illustrated in cross section, with an elongated channel 11 formed therein. The channel 11 should be formed to extend generally in the direction of flight of the fuze so that forces produced by impact of the fuze are directed generally parallel with the longitudinal direction of the channel 11. In all of the figures, the arming device is drawn so that the direction of movement, or flight, will be toward the bottom of the figure. The channel 11 is constructed with a pair of shoulders 12 approximately midway up the channel, with the shoulders 12 extending outwardly from either side of the channel 11. Adjacent the upper end, the channel 11 is again widened outwardly in both directions to form a second pair of shoulders 14.

An interrupter, or barrier, 15 is mounted in the housing 10 so as to slide longitudinally along the channel 11. In this specific embodiment the interrupter 15 is an elongated element constructed to fit within and be guided by the channel 11. The interrupter 15 has shoulders 17 adjacent the upper end thereof which project outwardly from each side of the interrupter 15 to engage the shoulders 12 in the channel 11 after sufficient downward movement of the interrupter 15. An elongated leaf spring element 20 is affixed to the upper end of the interrupted 15 by means of a screw 22. The leaf spring element 20 extends outwardly in both directions beyond the shoulder 17 of the interrupter 15 to engage the shoulders 14 of the channel 11.

In the position of the interrupter 15 illustrated in FIG. 1, the leaf spring 20 is engaged with the shoulders 14 in an unflexed mode and maintains the interrupter 15 in a first, or unarmed, position. An explosive detonating train 25 consists of an opening, having a circular cross section herein, through the housing 10 perpendicular to the longitudinal axis of the interrupter 15 and in communication with the channel 11 on each side of the interrupter 15. The interrupter 15 has an opening 27 formed therethrough which is similar in size to the explosive detonating train 25. When the interrupter 15 is in the first position, illustrated in FIG. 1, the opening 27 through the interrupter 15 is misaligned with the explosive detonating train 25 so that the train is interrupted by the body of the interrupter 15 and cannot operate. Therefore, the first position, illustrated in FIG. 1, is the unarmed, or normal position. In some instances it may be desirable to make 27 an explosive, or conducting, element rather than an opening. However, regardless how the detonating train operates, 27 is designed to complete the train or make it operative in this position illustrated in FIG. 2 and to render the detonating train inoperative in the position illustrated in FIG. 1.

The impact arming device is constructed so that the combination of the mass of the interrupter 15 and the spring force of the leaf spring 20, in cooperation, allow sliding movement of the interrupter 15 downwardly only upon the application of at least a predetermined amplitude of impact force on the fuze. Through adjustment of the mass of the interrupter 15 and the size, thickness, material, etc. of the leaf spring 20, the exact amount or amplitude of impact force required to move the interrupter 15 downwardly into the position illustrated in FIG. 2 can be precalculated or predetermined. In the second position, illustrated in FIG. 2, the shoulders 17 of the interrupter 15 engage the shoulders 12 of the channel 11 to stop downward movement of the interrupter 15. The spring 20 is flexed, or bent, to allow it to disengage with the shoulders 14 and enter the channel 11 as the interrupter 15 moves downwardly. In the second position, illustrated in FIG. 2, the opening 27 through the interrupter 15 is moved downwardly into alignment with the explosive detonating train 25 and, therefore, the second position is the armed position.

The outer edges of the leaf spring 20 are cut to form a relatively sharp edge. Thus, when the leaf spring 20 is in the flexed position, illustrated in FIG. 2, the sharp outer edges thereof gouge into the walls of the channel 11 to firmly hold the interrupter 15 in the second position. To ensure positive gouging action the leaf spring 20 may be formed of a relatively hard material, such as steel or the like, and at least the walls of the channel 11 may be formed of some relatively soft material, such as aluminum or the like. The ends of the leaf spring 20 may be cut square, or if desired, may be cut at an angle such that the lower edge at each outer end of the leaf spring 20 is less than 90 degrees, to increase the sharpness thereof. Thus, when the predetermined amplitude of impact force on the fuze drives the interrupter 15 into the second position, the leaf spring 20 frictionally engages the walls of the channel 11 to prevent bounce or any movement of the interrupter 15 out of the second position.

Figure 3:
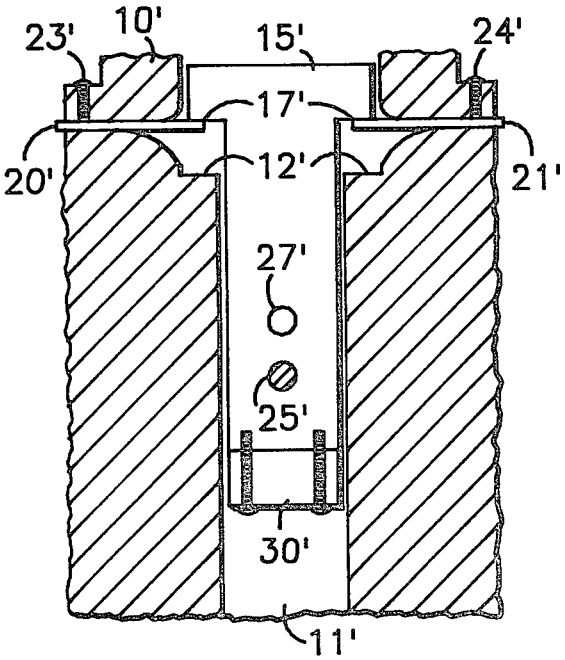
FIG. 3 is a view, similar to FIG. 1, of another embodiment, with the impact arming device in the unarmed position.
Figure 4:
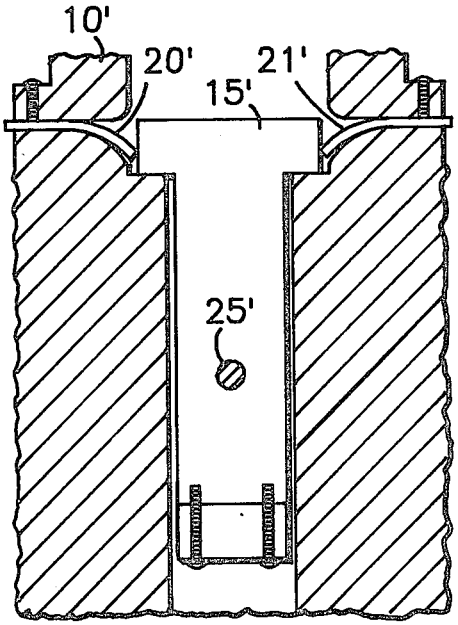
FIG. 4 is a view similar to FIG. 3 with the impact arming device moved to the armed position.

Referring specifically to FIGS. 3 and 4, a second embodiment of the impact arming device is illustrated wherein the leaf spring element is mounted in the housing, rather than on the interrupter. In this embodiment an interrupter 15' is slideably mounted in a channel 11'. The channel 11' has a pair of shoulders 12' formed therein midway up the channel 11' and extending outwardly to form stops for a pair of shoulders 17' formed in the interrupter 15'. A spring element 20' and 21' is inserted in an opening in the housing 10' on each side, respectively, of the channel 11' to extend therein and engage the shoulders 17' of the interrupter 15' in the unflexed position, illustrated in FIG. 3. The spring elements 20' and 21' maintain the interrupter 15' in the first, or unarmed, position. In this position an opening 27' is misaligned with an explosive detonating train 25'. Each of the leaf spring elements 20' and 21' are removably engaged in the slots by means of screws 23' and 24' respectively, so that leaf springs of different size, material, weight, etc., may be substituted therefor to change the predetermined amplitude of impact force required to move the interrupter 15' from the first position to the second position. In addition, the mass of the interrupter 15' may be changed by adding or subtracting weights 30' to the bottom thereof. It will of course be understood that the mass of the interrupter 15' may be changed by adding weight at other places, such as the top, or by simply increasing the weight, such as by exchanging the interrupter with an interrupter made of different material.

Referring specifically to FIG. 4, the interrupter 15' has moved into the second, or armed position, under the impetus of a predetermined amplitude of impact force on the fuze, and the spring elements 20' and 21' are flexed downwardly to engage the sides of the interrupter 15' and prevent the return thereof, or any movement out of the second position. In this embodiment the spring elements 20' and 21' are formed of a relatively hard material and the sides of the interrupter 15' are formed of a somewhat softer material so that the edges of the spring elements 20' and 21' gouge into the interrupter element 15' and prevent the movement thereof.

While both of the functions, maintaining the interrupter in the normal position until the application of a predetermined amplitude of impact force on the fuze and preventing movement of the interrupter out of the second position once it is attained, are performed by the spring element in the present embodiments for simplicity of manufacture and convenience, it will be understood by those skilled in the art that two or more elements might be utilized to perform the two functions. Further, two different embodiments of the spring element and interrupter are illustrated but it will be understood by those skilled in the art that many other embodiments might be devised to perform essentially the same functions. Thus, while we have shown and described specific embodiments of this invention, further modifications and improvements will occur to those skilled in the art. We desire it to be understood, therefore, that this invention is not limited to the particular forms shown and we intend in the appended claims to cover all modifications which do not depart from the spirit and scope of this invention.

We claim:

1. An impact arming device for a fuze containing a detonating train, said device comprising:

a housing;

an interrupter mounted in said housing for slideable movement between a first, unarmed, position and a second, armed, position;

said interrupter being formed to complete the detonating train in the second position and break the detonating train in the first position;

means affixed to one of said interrupter and said housing for normally maintaining said interrupter in the first position until the application of at least a predetermined amplitude of impact force thereto whereupon said interrupter is moved to the second position.

2. An impact arming device as claimed in claim 1 wherein the affixed means includes an element designed to engage the other of said interrupter and said housing when the interrupter is moved to the second position to prevent said interrupter from returning to the first position.

3. An impact arming device as claimed in claim 2 wherein the element designed to engage includes a leaf spring.

4. An impact arming device as claimed in claim 3 wherein the leaf spring is affixed to the one of said interrupter and said housing to extend therefrom in a relatively unflexed mode into engagement with the other of said interrupter and said housing to maintain said interrupter in the first position and to flex, upon the application of at least the predetermined amplitude of impact force, to engage the other of said interrupter and said housing to prevent said interrupter from returning.

5. An impact arming device as claimed in claim 4 wherein the other of said interrupter and said housing includes a shoulder positioned to be engaged by the leaf spring in the relatively unflexed mode.

6. An impact arming device as claimed in claim 5 wherein the leaf spring is attached adjacent an end of the interrupter in an outwardly extending relationship, generally transverse to the direction of slideable movement.

7. An impact arming device as claimed in claim 6 wherein the leaf spring extends outwardly in opposite directions from the interrupter and engages a shoulder in the housing adjacent each end of said leaf spring.

8. An impact arming device as claimed in claim 6 wherein the leaf spring removably mounted so as to be changeable with other leaf springs to change the predetermined amplitude of impact force required.

9. An impact arming device as claimed in claim 6 wherein the leaf spring includes a relatively sharp edge at the outwardly extending end of the leaf spring for frictionally engaging the housing.

10. An impact arming device as claimed in claim 9 wherein the leaf spring is formed of a relatively hard material and the engaged portion of the housing is formed of a relatively soft material.

11. An impact arming device for a fuze containing a detonating train, said device comprising:

a housing having a channel formed therein generally parallel with the normal direction of movement of the fuze;

an interrupter element mounted in said housing for slideable movments along the channel between a first position and a second position;

said interrupter element being formed to complete the detonating train in the second position and to break the detonating train in the first position; and a leaf spring element affixed to one of said interrupter element and said housing and engaged with the other of said interrupter element and said housing, with said interrupter element in the first position, to maintain said interrupter element in the first position until the application of at least a predetermined amplitude of impact force on the fuze whereupon said interrupter element is moved to the second position and to frictionally engage the other of said interrupter element and said housing to prevent said interrupter element from returning to the first position.

12. An impact arming device as claimed in claim 11 wherein the leaf spring element is removably affixed so as to be changeable with other leaf spring elements to change the predetermined amplitude of impact force required.

13. An impact arming device for a fuze containing a detonating train, said device comprising:

a housing having a channel formed therein generally parallel with the normal direction of movement of the fuze and further defining therein shoulders extending outwardly beyond said channel;

an elongated interrupter element mounted in said channel for slideable movements therealong between a first and a second position;

said interrupter element being formed to complete the detonating train in the second position and to break the detonating train in the first position;

a leaf spring element affixed to one end of said interrupter element so as to extend laterally outwardly therefrom into abutting engagement with said shoulders, said leaf spring being constructed with sufficient stiffness to remain engaged with said shoulders and maintain said interrupter element in the first position until the application of at least a predetermined amplitude of impact force on the fuze whereupon said interrupter element slides along said channel to the second position and said leaf spring element flexes into said channel; and said leaf spring element being further constructed to engage the channel when said interrupter element is in the second position to prevent said interrupter element from sliding out of the second position.

14. An impact arming device as claimed in claim 13 wherein the housing is further constructed to define at least one stop and the interrupter element is constructed to engage said stop in the second position for insuring completion of the detonating train.

* * * * *